United States Patent [19]

Wisniewski

[11] 4,240,361

[45] Dec. 23, 1980

[54] CHIMNEY SAFE HEAT SAVER

[76] Inventor: Alexander Wisniewski, 12 Cushing St., North Brookfield, Mass. 01535

[21] Appl. No.: 13,466

[22] Filed: Feb. 21, 1979

[51] Int. Cl.[3] ..... F23J 15/00; B01D 46/10

[52] U.S. Cl. ..... 110/119; 55/DIG. 20

[58] Field of Search ..... 110/119–123, 110/125, 126, 145, 184, 216, 217; 126/280; 55/441, 465, 462, DIG. 20

[56] References Cited

U.S. PATENT DOCUMENTS

| | | | |
|---|---|---|---|
| 411,327 | 9/1889 | Donnald | 55/DIG. 30 |
| 544,865 | 8/1895 | Peterson | 110/122 X |

*Primary Examiner*—Charles A. Ruehl

*Attorney, Agent, or Firm*—Charles R. Fay

[57] ABSTRACT

Safety device in the general form of an apertured disc which aids in keeping sparks and flames from paper, kindling, wood etc., from shooting up the chimney and possibly causing fire; the device also helps to stop soot build up and it controls the rate at which the wood burns, saving fuel.

4 Claims, 2 Drawing Figures

CHIMNEY SAFE HEAT SAVER

BACKGROUND OF THE INVENTION

It is, of course, well-known that a very important consideration at the present time is to conserve energy and many people are turning to wood to heat their houses. However, even when heating with wood, it is still important to save as much of the fuel as possible and to prevent the waste of heat and to this end this invention provides an easily manufactured and applied device which cooperates with a smoke pipe for the stove.

SUMMARY OF THE INVENTION

This invention provides a device to be applied to the outside of the usual chimney or smoke pipe at the lower end thereof, the latter being made to accommodate a connection to the device which is easily dismantled for cleaning.

The device comprises an inverted V-shaped support having a pair of diverging legs supported on an inverted cap. The inverted cap holds a short length of chimney pipe which has a larger diameter than the regular chimney pipe and is connected thereto in a way to prevent smoke from escaping.

The support carries an apertured circular disc having a down turned skirt, the disc holes being for the passage of smoke to the regular chimney pipe, the disc being of substantially the same diameter as the regular chimney pipe and having a lesser diameter than the short length of pipe aforesaid.

Rising from the disc at the side opposite the skirt there is an adjustable connection with respect to the regular chimney pipe and above the same there is provided a conventional damper which can be turned for opening and closing same as may be desired.

PREFERRED EMBODIMENT OF THE INVENTION

Figure 1:
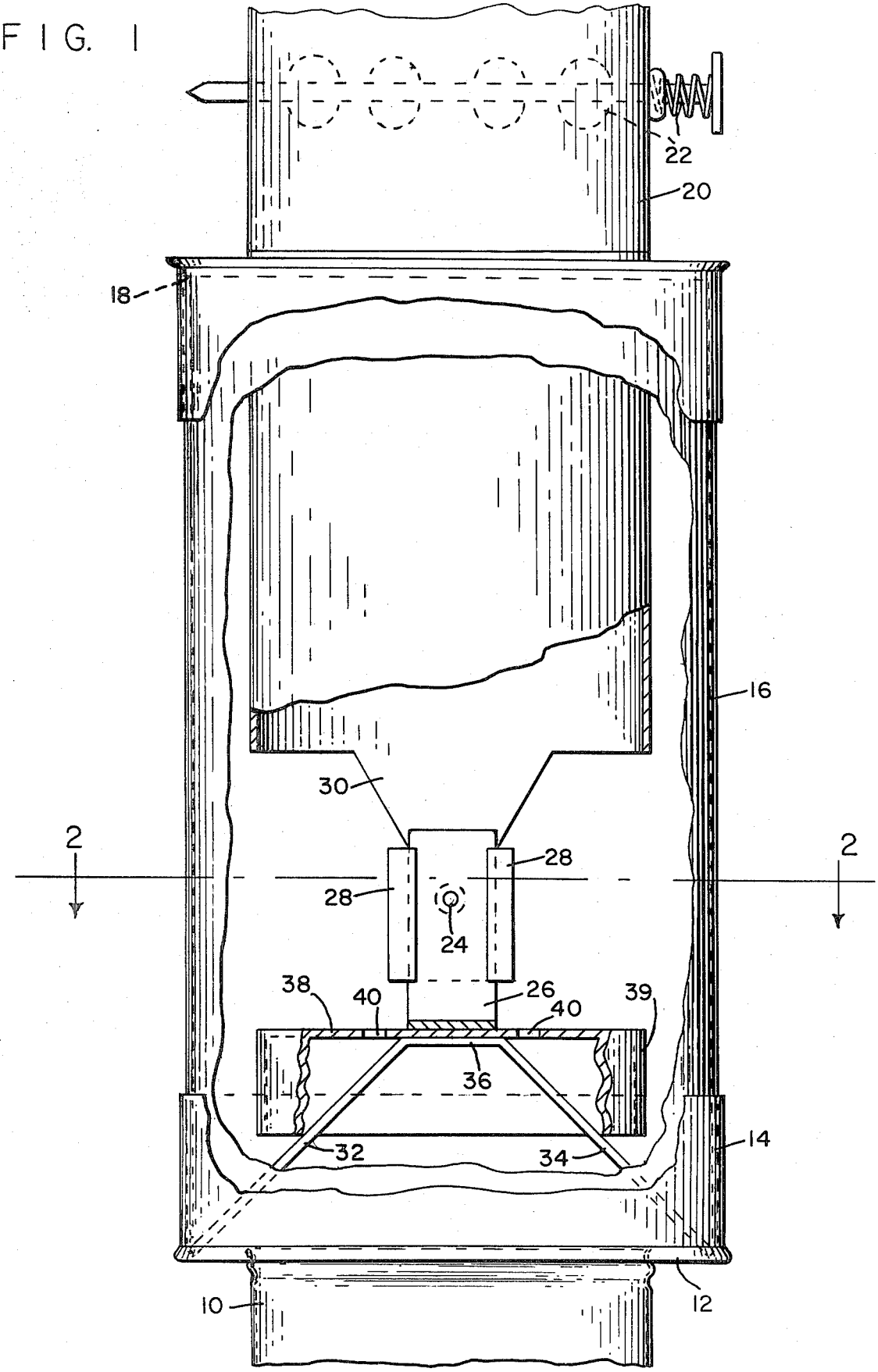
FIG. 1 is a cut away view illustrating the invention.
Figure 2:
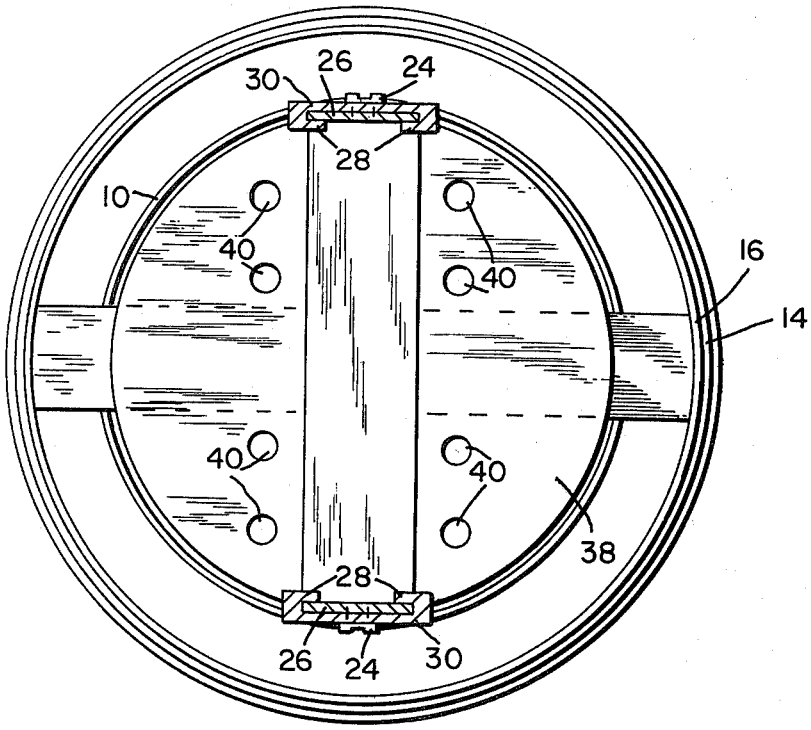
FIG. 2 is a section on line 2—2 of FIG. 1.

The stove is not shown in this case as it can be any kind of wood or coal burning stove but as usual there is an outlet member generally indicated at 10 which is normally oval or round and is applied to the smoke collar of the stove to position the parts.

Connected to the smoke collar there is an annular inverted cap generally indicated at 12 having a greater diameter than the outlet 10, and having a upwardly directed skirt 14 in which is placed a section of stove pipe 16 which just fits the inside the cap 14. The section of stove pipe 16 rises to a point generally indicated at 18 where there is an annular closure cap which is placed around the regular stove pipe 20, and in this regular stove pipe 20 there is mounted the usual damper indicated by the reference numeral 22. This damper is completely conventional.

It will be seen that the section of stove pipe 16 is greater in diameter than that of the regular stove pipe 20 and it is not secured thereto except by a pair of diametrically opposed fasteners 24 which extend through upwardly directed legs 26 and slide in guides 28 located on two spaced reduced portions 30 at opposite sides of the regular stove pipe for adjustable positioning of the device relative to the stove pipe 20.

The device itself has an interior support comprising two legs 32,34 which are divergent in a downward direction and rest on the annular cap 12 which is completely open and in alignment with the stove outlet 10.

These legs are provided with a base 36 mounting a disc 38 which may have holes 40 therein. The legs 32,34 are quite narrow but strong enough to support the disc together with its skirt 39 if present so that the smoke passes by the supports 32,34 through the holes 40 if present and also about the edge of disc 38 up into the space between the pipes 16 and 20, and eventually up through the regular chimney piece 20. There are two guides 28 on two reduced diametrically opposed portions 30 of the smoke pipe 20.

With the device in position it will be seen that a great deal of the draft is controlled by the disc 38, the smoke and possibly a few sparks ets., rising through holes 40 and around the edges of skirt 39 to ascend through the smoke pipe 20. It will also be noted that the skirt 39 on the device is approximately the same diameter as that of smoke pipe 20, and that the pipe 16 is larger than either one of these pieces to allow the smoke to ascent outside the skirt as well as through the holes 40.

The device is easily dismounted for cleaning or repair should this become necessary and it will be seen that the fire is controlled to some extent through the use of the conventional damper as always.

The effect of the device is to act as a safety device to keep sparks and flames from paper, kindling and wood etc., from shooting up the chimney and possibly causing a fire; it helps to stop soot build up in the chimney and any soot build up on the disc 38 may be cleaned off from time to time when the stove is cool.

Also the device helps control the rate at which the wood burns and it will be seen that although a large fire may be occasioned in the stove, the draft is blocked to some degree in addition to the damper. It has been found through actual use that a load of wood has at least eight to twelve hours longer to burn than otherwise would be the case, but at the same time, in most instances, sufficient heat for the room or several rooms is provided at a much lower cost to the consumer.

I claim:

1. The safety and energy saving device for the conventional smoke pipe of a stove which comprises in combination with the conventional smoke pipe a length of pipe having a greater diameter than the conventional smoke pipe and conforming in shape thereto, and being associated therewith at the lower end thereof between the conventional smoke pipe and the stove, an annular inverted cap supporting said length of greater diameter, said cap being supported with respect to the stove, a support in said cap, said support extending upwardly therefrom, a disc-like member on said support, apertures in said disc-like member and a connection on said disc-like member connecting the same with respect to the lower end of the conventional smoke pipe.

2. The safety and energy saving device of claim 1 wherein said disc-like member approximates in diameter the diameter of the conventional smoke pipe.

3. The safety and energy saving device of claim 1 including a downwardly extending skirt on said disc-like member at the periphery thereof.

4. The safety and energy saving device of claim 1 including a conventional damper in said conventional smoke pipe, said damper being located above the upper end of said enlarged length of pipe which houses the device.

* * * * *